US005838347A

United States Patent [19]

Inamoto et al.

[11] Patent Number: 5,838,347

[45] Date of Patent: Nov. 17, 1998

[54] COATING METHOD FOR SURFACE TREATMENT OF AN INK JET RECORDING HEAD

[75] Inventors: Tadayoshi Inamoto, Machida; Haruo Uehara, Yokohama; Hiromichi Noguchi, Atsugi; Akihiko Shimomura, Tokyo; Eiko Moriyama, Hachioji, all of Japan

[73] Assignee: Canon Kabushiki Kaisha, Tokyo, Japan

[21] Appl. No.: 465,573

[22] Filed: Jun. 5, 1995

Related U.S. Application Data

[63] Continuation of Ser. No. 339,750, Nov. 15, 1994, abandoned, which is a continuation of Ser. No. 897,062, Jun. 11, 1992, abandoned, which is a division of Ser. No. 630,760, Dec. 21, 1990, Pat. No. 5,148,193, which is a continuation of Ser. No. 415,467, Oct. 2, 1989, abandoned, which is a continuation of Ser. No. 119,738, Nov. 12, 1987, abandoned.

[30] Foreign Application Priority Data

| | | | |
|---|---|---|---|
| Nov. 13, 1986 | [JP] | Japan | 61-268493 |
| Nov. 13, 1986 | [JP] | Japan | 61-268494 |
| Nov. 13, 1986 | [JP] | Japan | 61-268496 |

[51] Int. Cl.[6] ..... B41J 2/16

[52] U.S. Cl. ..... 347/45; 118/259; 427/428

[58] Field of Search ..... 347/45, 47; 118/259, 118/258, 260–262; 427/428

[56] References Cited

U.S. PATENT DOCUMENTS

| | | | |
|---|---|---|---|
| 2,747,541 | 5/1956 | Chew | 118/259 X |
| 3,366,091 | 1/1968 | Moll | 118/259 |
| 3,371,001 | 2/1968 | Ettre | 156/234 |
| 3,468,286 | 9/1969 | Nugarus | 118/259 X |
| 3,535,157 | 10/1970 | Steinhoff | 427/428 X |
| 3,941,312 | 3/1976 | Ohno | 347/55 |
| 4,060,441 | 11/1977 | Ohta | 156/234 |
| 4,251,824 | 2/1981 | Hara et al. . | |
| 4,296,421 | 10/1981 | Hara et al. . | |
| 4,325,995 | 4/1982 | Tamura | 427/428 |
| 4,330,787 | 5/1982 | Sato et al. . | |
| 4,368,476 | 1/1983 | Uehara | 347/45 |
| 4,376,945 | 3/1983 | Hara et al. . | |
| 4,417,251 | 11/1983 | Sugitani . | |
| 4,420,764 | 12/1983 | Okada . | |
| 4,450,455 | 5/1984 | Sugitani | 347/45 |
| 4,459,600 | 7/1984 | Sato et al. . | |
| 4,463,359 | 7/1984 | Ayata et al. . | |
| 4,492,966 | 1/1985 | Seki et al. . | |
| 4,520,373 | 5/1985 | Ayata et al. . | |
| 4,623,906 | 11/1986 | Chandrashekhar | 347/47 |
| 4,701,766 | 10/1987 | Sugitani et al. . | |
| 4,707,705 | 11/1987 | Hara et al. | 347/47 |

FOREIGN PATENT DOCUMENTS

| | | | |
|---|---|---|---|
| 2439073 | 5/1980 | France . | |
| 57-157764 | 9/1982 | Japan . | |
| 59-176054 | 10/1984 | Japan . | |
| 24956 | 2/1985 | Japan | B41J 3/04 |
| 54857 | 3/1985 | Japan | B41J 3/04 |
| 8201414 | 4/1982 | WIPO . | |

OTHER PUBLICATIONS

Ichikawa, I., "Plain Science of Paper, Ink and Printing", cover, title page, pp. 155–157 (Foundation Printing Bureau Choyou–Kai, Sep. 15, 1981), translation of p. 155, last line, to p. 156, last line.

*Primary Examiner*—Joseph W. Hartary
*Attorney, Agent, or Firm*—Fitzpatrick, Cella, Harper & Scinto

[57] ABSTRACT

A method for surface treatment of an ink jet recording head, having the step of transferring a surface treating agent provided on a support to the ink discharging opening surface having ink discharging openings of an ink jet recording head formed thereon from said support.

3 Claims, 7 Drawing Sheets

COATING METHOD FOR SURFACE TREATMENT OF AN INK JET RECORDING HEAD

This application is a continuation of application Ser. No. 08/339,750 filed Nov. 15, 1994; which was a continuation of application Ser. No. 07/897,062 filed Jun. 11, 1992, both now abandoned; which was division of application Ser. No. 07/630,760 filed Dec. 21, 1990, now U.S. Pat. No. 5,148,193 which was a continuation of application Ser. No. 07/415,467 filed Oct. 2, 1989; which was an Continuation of application Ser. No. 07/119,738 filed Nov. 12, 1987, both also now abandoned.

BACKGROUND OF THE INVENTION

1. Field of the Invention

This invention relates to a method for surface treatment of an ink jet recording head which performs recording by permitting an ink which is the recording liquid to be discharged and fly as droplets through ink discharging openings and attaching the droplets onto a recording medium surface, more particularly to a method for surface treatment of an ink jet recording head which covers the surface having ink discharging openings with a surface treating layer.

2. Related Background Art

The ink jet recording method performs recording by permitting droplets of a recording agent called ink and attaching them onto a recording member such as paper, etc. The method includes the so-called ink-on demand system.

According to such ink jet recording system, it is demanded for improvement of recording quality that the ink droplets should be attached on the required position of the recording surface, namely that the discharging direction of the flying droplets for recording should be constant, and the discharging speed also constant and the sizes of the flying droplets uniform.

However, in the ink jet recording head, when the surface having discharging openings is coarsened or has flaws such as cracks or defects formed thereon, ink will be attached nonuniformly on the surface having discharging openings during continuous discharge of ink, whereby the ink is drawn nonuniformly when the ink is discharged through the ink discharging openings and released therefrom, and therefore the discharging direction and the discharging speed, and also the sizes of the ink droplets were varied to bring about lowering in recording quality. Also, in an ink jet recording head produced by the invention in which the ink discharging openings are constituted of different kinds of materials as disclosed in U.S. Pat. No. 4,417251, since wettability with ink differ depending on the respective constituent materials, localization of ink is also liable to occur on the surface having ink discharging openings while discharging of ink is continued for a long time, whereby the problems as mentioned above will readily occur.

As the method for such drawbacks, there have been made a large number of proposals to provide uniformly a liquid repellent or liquid compatible material on the surface having ink discharging orifices. However, when various points in manufacture, for example, cost, precision, yield, etc. are considered, no satisfactory product has been obtained under the present situation. In the other words, there is no method for sufficient surface treatment which can be uniformly and simply applied to ink discharging openings without entrance of a surface treating agent to the inner direction of ink discharging openings.

SUMMARY OF THE INVENTION

An object of the present invention is to solve such problems as described above and provide a method for surface treatment of ink jet recording head capable of making an ink jet recording head with high recording quality, with the surface on which discharging openings are provided being covered with a uniform material, which can eliminate nonuniformness in shape such as coarseness or flaw, etc. on the surface, thereby making constant the discharging direction, the discharging speed and the sizes of discharge ink droplets.

Also, another object of the present invention is to provide a method for surface treatment of ink jet recording head which can make ink jet recording heads at low cost without entrance of the surface treating agent into the ink discharging opening during the treatment, whereby no step of packing fillers in ink discharging openings is required.

Still another object of the present invention is to provide a method for surface treatment of ink jet recording head which can exclude restriction imposed on designing such as change of the ink discharging openings before the treatment, etc.

According to the present invention, there is provided a method for surface treatment of an ink jet recording head, having the step of transferring a surface treating agent provided on a support to the ink discharging opening surface having ink discharging openings of an ink jet recording head formed thereon from said support.

BRIEF DESCRIPTION OF THE DRAWINGS

FIG. 2A and 2B are schematic sectional views for illustration of the steps of performing the surface treatment by the method according to the present invention for the ink jet recording head shown in FIGS. 1A and 1B;

DETAILED DESCRIPTION OF PREFERRED EMBODIMENTS

Figure 1A:
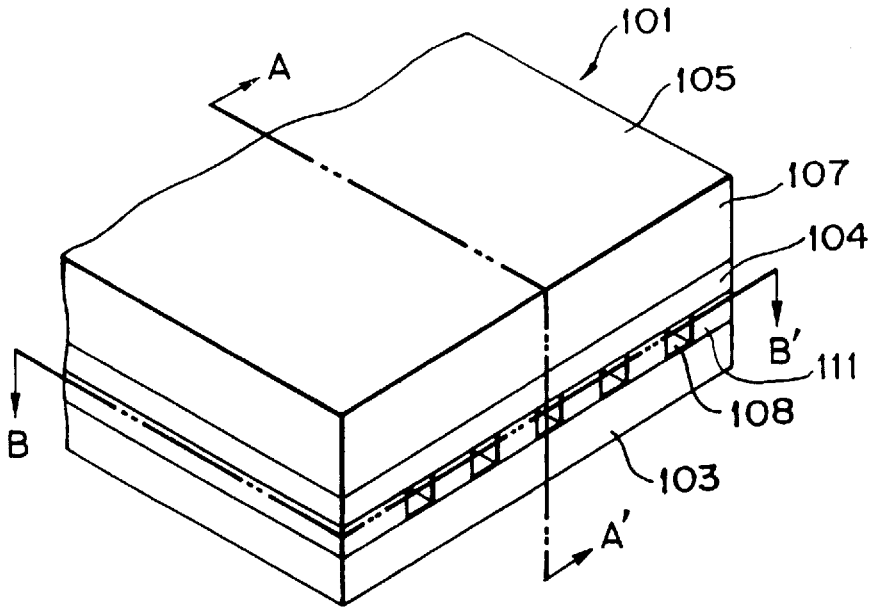
FIGS. 1A and 2B are a schematic perspective view showing one example of the ink jet recording head for which the present invention is applicable and a schematic sectional view thereof taken along the A–A' plane, respectively.

Referring now to the drawings, the present invention is to be described in detail.

In the present invention, the problem is to be solved primarily around the ink discharging opening, and therefore only the portions including discharging openings are extracted in detail in the following description. However, so long as the spirit of the present invention is followed, for example, the ink jet recording head as shown in the drawing is not limitative, but the present invention is effectively applicable for an ink jet recording head of any form.

In the present invention, by transferring at least a portion of treating agent provided on a support to the ink discharging surface having ink discharging openings of an ink jet recording head formed thereon from said support, a surface treated layer of ink-repellent nature (water-repellent for aqueous ink or oil-repellent for oily ink) is formed on said ink discharging opening surface.

The surface treating agent can be selected suitably as desired within the range which satisfies the condition that the surface treated layer finally formed on the ink discharging orifice surface has ink repellency and the object of the present invention is accomplished. That is, the surface treating agent itself may be a material having originally ink repellency or a material which becomes to have ink repellency by application of some treatment. In either case, the surface treated layer formed eventually must have an ink-repellent nature.

The surface treating agent to be used in the present invention includes comprehensively liquid-and solid-form treating materials themselves contributing directly to ink repellency of the above surface treated layer, solutions containing said surface treating material in a solvent and the dispersion containing said surface treating material in a dispersing medium, etc.

To provide a surface treating agent on a support, there are used liquid-or solid-form photosensitive resins, liquid-or solid-form thermosetting resins, liquid-or solid-form coupling agents, solutions containing at least one of the above materials, dispersions containing at least one of the above materials, etc.

As a support to be provided with the surface treating agent on its surface, there are used liquid materials such as glass, metals, ceramics, non-elastic plastics, wood, etc., or alternatively elastic materials such as rubber, elastic plastics. Among these, elastic materials are preferably used.

Specific examples of the surface treating agent and the support are illustrated later in the descriptions of respective working embodiments ([I], [II] (i) and [II] (ii)). They are however not restricted to those examples illustrated in the embodiments.

In the present invention, the ratio of the thickness of surface treating agent provided on a support relative to the diameter of ink discharging opening should be preferably one third or less, more preferably one fourth or less, optimally one fifth or less. This is because greater ratio may allow the surface treating agent enter the insides of ink discharging openings and close the openings.

However, in case the ink discharging openings are considerably large, the surface treating agent possibly enter the inside thereof even when the above ratio is one third or less. Therefore, the thickness of the surface treating agent on a support should be preferably 10 $\mu$m or less, more preferably 8 $\mu$m or less, optimally 6 $\mu$m or less.

Additionally, the thickness of the surface treating agent on a support should be preferably 0.1 $\mu$m or greater, more preferably 0.2 $\mu$m or greater, optimally 03. $\mu$m or greater. This is because too small thickness of the surface treating agent makes it difficult to provide the surface treating agent onto the support as well as often provides uniform coating of the surface treating agent or on the ink discharging surface.

Previous curing treatment may be effected to the surface treating agent provided on the support.

In the following, the three preferred embodiments shown below are to be described.

[I] A liquid (under an ordinary use environment of ink jet recording head) surface treating agent is transferred from the support onto the ink discharging opening surface and then subjected to curing treatment to form a surface treated layer.

[II] (i) A solid (under an ordinary use environment of ink jet recording head) surface treating agent is transferred from the support onto the ink discharging opening surface to form a surface treated layer.

[II] (ii) A surface treated layer is formed in the same manner as in [II] (i) supra except that the surface treating agent is irradiated with active light beam upon transfer under the state that the support and the ink discharging surface are combined to a unity with interposing the surface treating agent therebetween.

The above three embodiments have been described in detail as preferred embodiments in the present invention, and particularly the above embodiments [II] (i) and [II] (ii) are most preferred.

Also, in these embodiments, as described later, before or after performing the above transfer, there may be also added the step of further curing the surface treating agent, etc., as desired.

[I] In this first embodiment, a support having thereon a liquid surface treating agent is contacted with an ink discharging surface and then separated, thus transferring the surface treating agent from the support to the ink discharging surface to form a surface treated layer on the ink discharging surface.

In this embodiment as a liquid surface treating agent, any material which is liquid until transferred and forms a solid layer after some treatment thereafter as desired can be used. Specifically, there may be included liquid photosensitive resins, photosensitive resin solutions in solvents or liquid thermosetting resins, thermosetting resin solutions in solvents and further liquid coupling agents such as silane type, titanate type, chromium type and aluminum type or solutions thereof. As the solidification treatment, drying treatment including natural drying and forced drying by e.g. heating may be selected for solutions, irradiation treatment of photosensitive resins and solutions thereof with actinic active rays for the photosensitive resins, and heating treatment for thermosetting resins, etc.

Further, as a support to be provided thereon with a surface treating agent, there may include specifically solids such as glass, metal, ceramics, wood, rubber, plastics, etc. The surface coated with the surface treating agent has preferably a shape which can be contacted uniformly with the discharging orifice surface, in the case of a liquid material (non-elastic material) difficultly deformed such as glass, metal, ceramics, wood, non-elastic plastics, etc., while it does not necessarily have the same surface shape as the discharging orifice surface, in the case of a elastic support which is itself deformable such as rubber, plastic film, etc. Elastic supports are preferably used in the present invention.

Figure 1B:
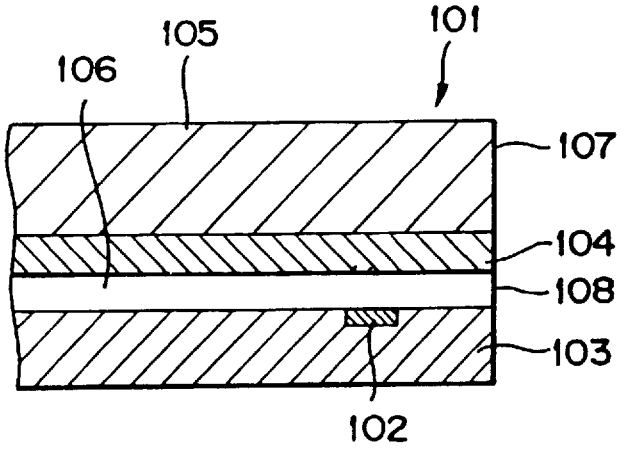

FIGS. 1A and 1B illustrate a schematic perspective view of a vicinity the ink discharging opening 108 of the ink jet recording head comprising a plurality of openings by use of an electrothermal converting element as means for liquid discharging energy generation, as an example of the ink jet recording head for which the present invention is applicable, and its sectional view taken along the A–A' plane, respectively.

Here, 101 is an ink jet recording head as a whole, 102 a heat generating element as electrothermal converting member, 103 a substrate, 104 an adhesive layer, 105 a ceiling plate, 106 an ink pathway, 107 the surface having ink discharging openings (discharging surface), 108 an ink discharging opening, 111 and ink pathway wall constituting member delimiting the ink pathway 106 and the ink discharging opening 108.

The following describes briefly about the liquid discharging principle of such ink jet recording head in which heat is used as the liquid discharging energy. The heat generating element 102 generates heat for an instant by passing current in pulses through a conductive wire not shown to the heat generating element 102 provided on the substrate 103, which heat effects foaming of the ink existing within the ink pathway to generate abrupt change in pressure, thereby discharging the ink through the ink discharging orifice 108.

In the ink jet recording head shown in these figures, particularly in the case different kinds of materials are employed to constitute the ink discharging surface 107, wettability is not uniform, whereby discharging is liable to become unstable.

Accordingly, in the method according to the first embodiment of the present invention, the following surface treatment is practiced.

EXAMPLE 1

Figure 2A:
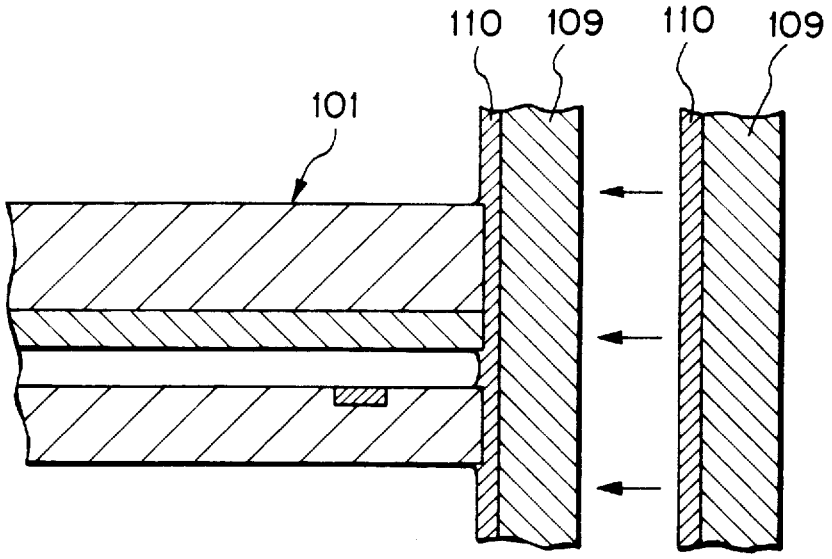
Figure 2B:
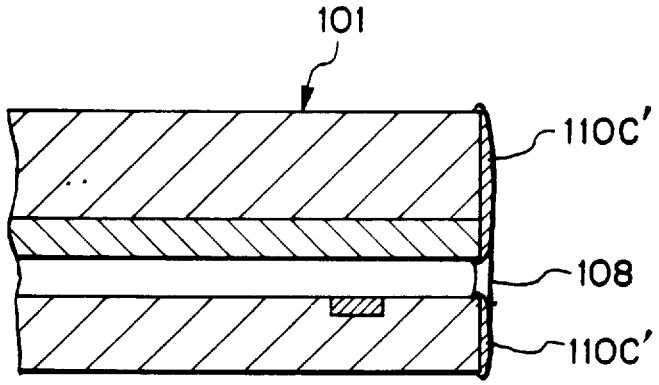

FIGS. 2A and 2B show the surface treatment process according to the first embodiment of the present invention, which are schematic sectional views taken along the A–A' plane of the ink jet recording head 101 shown in FIG. 1A.

First, as shown in FIG. 2A, the support 109 coated with a UV-ray curable type photosensitive resinsolution (surface treating agent) 110 having a composition shown in Table 1 is pushed against the ink jet recording head 101 having an ink discharging opening of 30 μm diameter. In this example as the support 109, a polyester film (25 μm thickness) was employed. Coating of the surface treating agent 110 on the support 109 was performed by use of a wire bar coater.

Next, when the support 109 was released from the head 101, the surface treating agent 110 C' remained on the ink discharging surface 107. Holding the surface provided with the surface treating agent 110 C', UV-ray was irradiated from an ultra-high pressure mercury lamp of 1 KW for one minute from above, to cure the liquid resin 110 C' and form a surface treated layer on the ink discharging surface.

Figure 3:
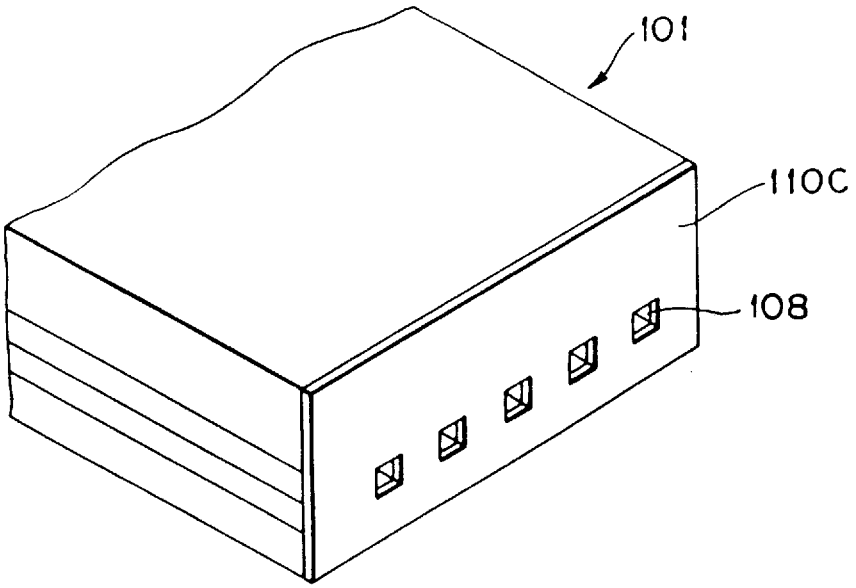
FIG. 3 is a schematic perspective view of the ink jet recording head after completion of the surface treatment according to the present method.

FIG. 3 is a schematic perspective view of the vicinity of the ink discharging opening of the ink jet recording head provided with a surface treated layer 110 C after completion of the surface treatment.

TABLE 1

| | wt. parts |
|---|---|
| PHOTOMER 6008 (produced by SUN NOPCO LID.) | 40 |
| RIPOXY VR-60 (produced by SHOWA HIGH POLYMER Co., LTD.) | 10 |
| Trimethylolpropane triacrylate | 20 |
| N-vinylpyrrolidone | 30 |
| A-189 (produced by NIPPON UNICAR Co.,LTD.) | 0.2 |

TABLE 1-continued

| | wt. parts |
|---|---|
| Aron G(GF-300) (produced by Toa Gosei Kagaku Kogyo K.K.) | 0.1 |
| IRGACURE 651 (produced by CIBA-GEIGY Co.) | 5.0 |
| Tert-butyl hydroquinone | 0.03 |

In this EXAMPLE 1, the thickness of surface treating agent provided on a support was varied as shown in TABLE A and the surface treatment was effected to 100 heads for each thickness. The results are shown in TABLE A.

TABLE A

| Thickness of Surface Treating Agent on Support (μm) | Ratio of Ink discharging Opening/Thickness in the Left Column | Result |
|---|---|---|
| 0.1 | 1/300 | Ununiform Surface Treatment in One of 100 Heads |
| 0.3 | 1/100 | Successful in All Heads |
| 0.6 | 1/50 | ditto |
| 3 | 1/10 | ditto |
| 6 | 1/5 | ditto |
| 7.5 | 1/4 | Surface Treating Agent Intrusion into Ink Discharging Opening in One of 100 Heads |
| 10 | 1/3 | Surface Treating Agent Intrusion into Ink Discharging Opening in two of 100 Heads |
| 15 | 1/2 | Surface Treating Agent Intrusion into Ink Discharging Opening in 22 of 100 Heads |

Figure 4:
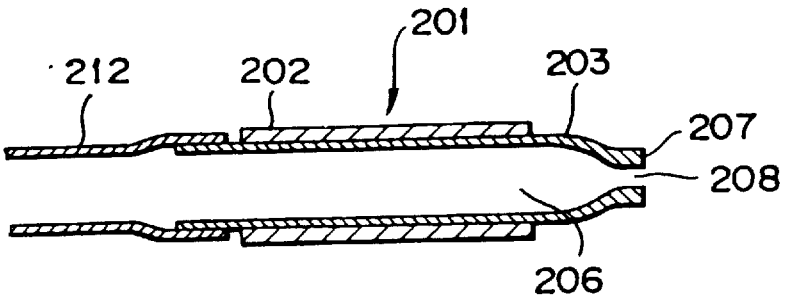
FIG. 4 is a schematic sectional views showing another example of the ink jet recording head for which the present invention is applicable.

FIG. 4 shows as a schematic sectional view another example of the ink jet recording head for which the method of the present invention is applicable, and an electromechanical converting element is used as means for generation of discharging energy. Such ink jet recording head 201 has a piezoelectric element 202 arranged as the ink discharging energy generating means around the glass tube 203 having an opening narrowed finely, namely an ink discharging opening 208, prepared by melting and drawing the glass tube, followed by cutting. To describe briefly about the discharging principle of the ink jet recording head, the ink is introduced into the ink pathway 206 within the glass tube 203 by passing through the innerside of the ink introducing tube 212. When a voltage in pulses is applied on the piezoelectric element 202, the piezoelectric element 202 is deformed and causes volume change of the ink passway 206, whereby the ink is discharged through the ink discharging opening 208. Even in such ink jet recording head 201, the surface having the ink discharging orifice (ink discharging surface), 207 can be covered uniformly with a surface treated layer according to the method of the present invention.

EXAMPLE 2

Figure 5:
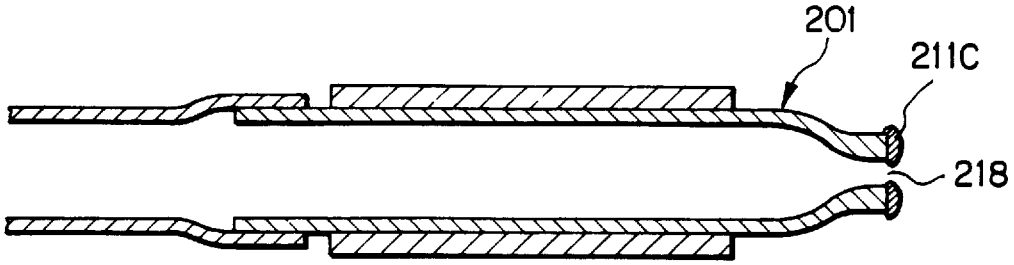
FIG. 5 is a schematic sectional views for illustration of the ink jet recording head shown in FIG. 4 after completion of the surface treatment according to the present method.

FIG. 5 is a schematic sectional view for illustration of an ink jet recording head after completion of surface treatment according to a second example of the first embodiment of the present invention.

First, by use of the epoxy resin solution as shown in Table 2 as the surface treating agent, this was applied by a wire bar coater on a 25 μm, polyester film and the coated film was pushed against the surface 207 (FIG. 4) having ink discharging openings of 50 μm diameter to transfer the surface treating agent in liquid form, followed by heating preliminary at 80° C. for 30 minutes and then effecting main heating at 150° C. for 2 hours to cure the surface treating agent. As the result, an ink jet recording head having a surface treated layer 211 C as shown in FIG. 5 was obtained.

TABLE 2

| | wt.parts |
|---|---|
| EPIKOTE 828 (produced by Yuka Shell Epoxy) | 80 |
| EPIKOTE 152 | 20 |
| 2-Ethyl-4-methylimidazole | 5 |
| Toluene | 200 |

In this EXAMPLE 2, the thickness of surface treating agent provided on a support was varied as shown in TABLE B and the surface treatment was effected to 100 heads for each thickness. The results are shown in TABLE B.

TABLE B

| Thickness of Surface Treating Agent on Support (μm) | Ratio of Ink discharging Opening/Thickness in the Left Column | Result |
|---|---|---|
| 0.1 | 1/500 | Successful in All Heads |
| 0.17 | about 1/300 | ditto |
| 0.5 | 1/100 | ditto |
| 1 | 1/50 | ditto |
| 5 | 1/10 | ditto |
| 10 | 1/5 | ditto |
| 12.5 | 1/4 | Surface Treating Agent Intrusion into Ink Discharging Opening in 19 of 100 Heads |

Figure 6:
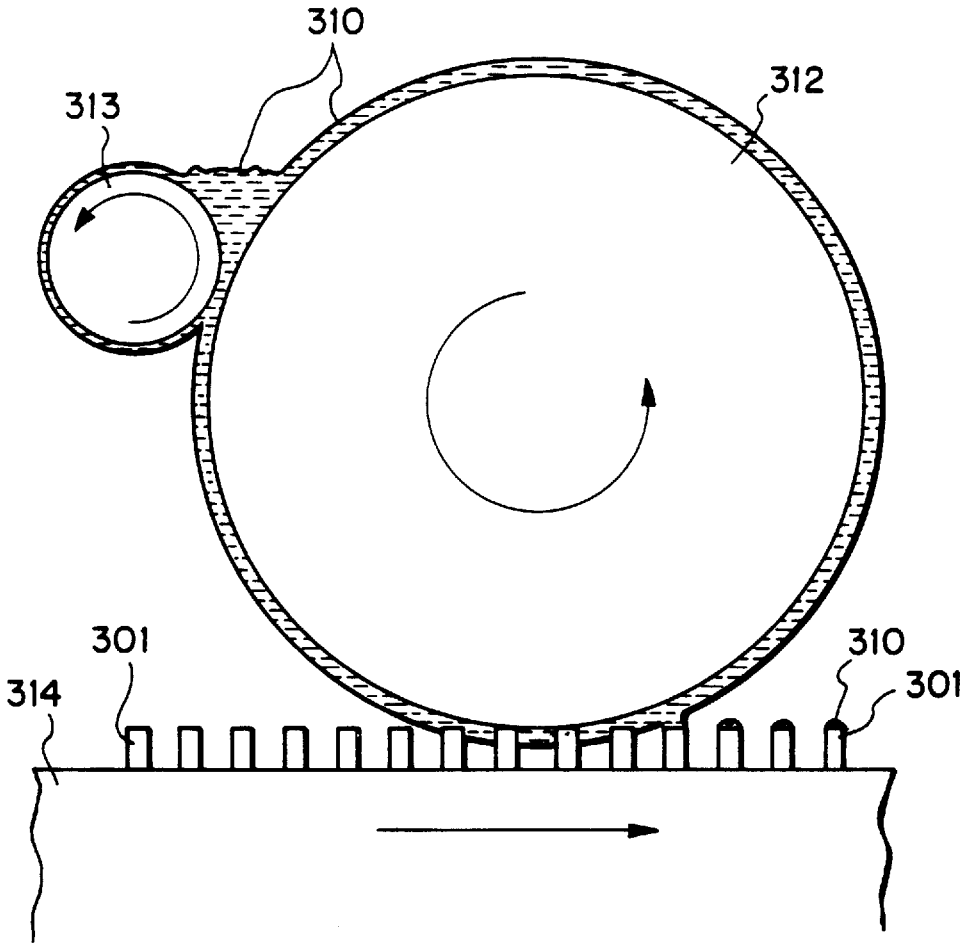
FIG. 6 is a schematic view for illustration of one example of the treatment for transferring a liquid surface treating agent to the ink jet recording head.

FIG. 6 schematically shows a mass production example of the treatment using a liquid surface treating agent on a recording head as shown in FIGS. 1A and 1B or in FIG. 4.

The liquid surface treating agent 310 is formed to a uniform thickness with the reverse roll 313 and the coating roll 312 which is the support. The ink jet recording 301 to be treated is set on the conveyor 314 so that the ink discharging surface may contact the liquid surface treating agent 310 coated on the coating roll 312. When the ink jet recording head 301 contacts the liquid surface treating agent 310, the liquid surface treating agent 310 is transferred onto the ink discharging surface with high efficiency. Then, by performing the solidification treatment of the surface treating agent as described above to form a surface treated layer, the ink discharging opening surface treatment is completed.

[II] (i) Next, examples of the second embodiments of surface treating process are described below.

A support having a solid surface treating agent provided thereon is bonded onto an ink discharging surface and thereafter peeled off, thereby transferring the surface treating agent from the support to the ink discharging surface to form a surface treated layer on the ink discharging surface. As a support, there may be used glass, metal, ceramics, wood, rubber, plastics, etc. To provide a solid surface treating agent on a support, there may be used photosensitive resins, thermosetting resins, solution of these resins, etc. These resins or resin solutions are applied in liquid or solid form. In case they are applied in liquid form, solidification treatment will be effected simultaneously or subsequently of the application onto a substrate. Also, previously solidified resins or resin solutions may be applied on to a substrate.

Here, concerning the support and the solid surface treating agent, the following force relationships are preferably satisfied, because it is required that when the support is peeled off after the solid surface treating agent is bonded to the ink discharging surface, the solid surface treating agent faced to the ink discharging opening should be removed as attached on the support, while the solid surface treating agent faced directly to the ink discharging surface should be peeled off at the interface of the support without cohesive destruction at the portion adhered to the ink discharging surface to be attached on the ink discharging surface.

That is, (Adhesive force between solid surface treating agent and support)<

(Cohesive force of solid surface treating agent); and (Adhesive force between solid surface treating agent and support)<

(Adhesive force between solid surface treating agent and ink discharging surface)

EXAMPLE 3

Figure 7:
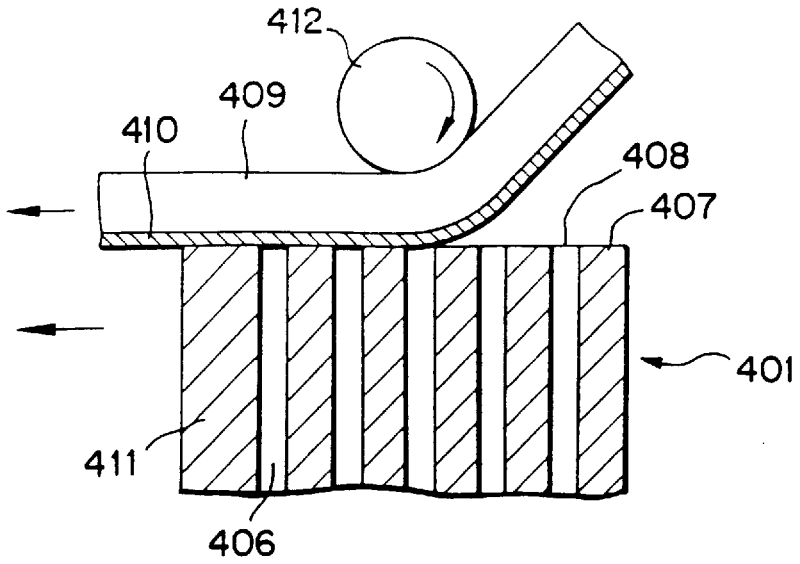
FIGS. 7 and 8 are schematic sectional views for illustration of other examples of the surface treatment method of the present invention.
Figure 8:
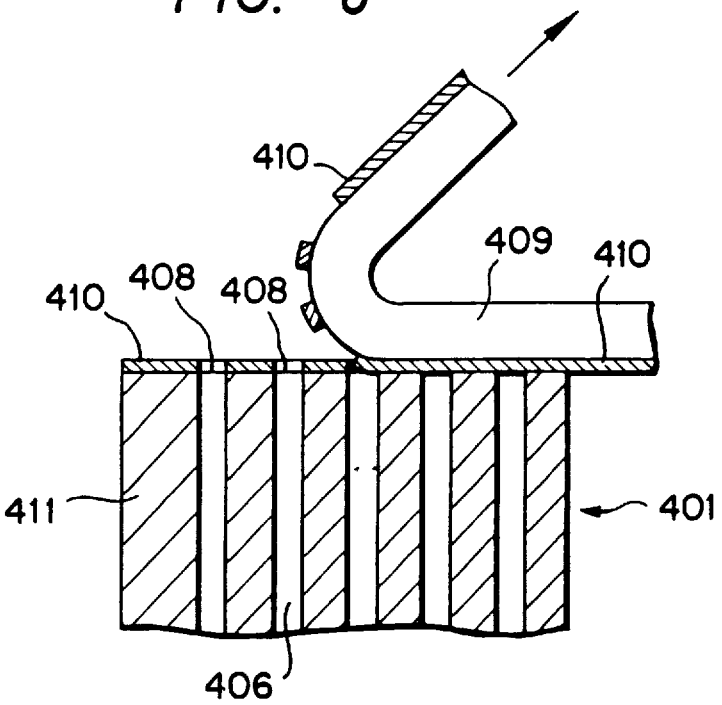

FIGS. 7 and 8 show surface treatment examples according to the second example of the present invention, which are schematic sectional views taken long the B–B' plane of the ink jet recording head 101 shown in FIG. 1A.

First, as shown in FIG. 7, a photosensitive resin having a composition as shown in Table 3 is applied by a wire bar on the support 409 of a polyester film (thickness 25 μm) and then dried to obtain a solid surface treating agent 410. This was pressure adhered onto the ink discharging surface 407 of the ink jet recording head 401 of an ink discharging opening diameter of 40 μm by use of roller 412, etc. Next, as shown in FIG. 8, the support 409 is peeled off. At this time, the portion of the solid surface treating agent 410 faced to the ink discharging opening 408 remains on the support 409 side, while the portion of the solid surface treating agent 410 directly faced to the ink discharging surface remains on the ink jet recording head 401 side. This is due to the relationship of the adhesive force of the solid surface treating agent 410 to the support 409 and the ink discharging surface 407 and the cohesive force of the solid resin 410 as described above. Also, at the end portion of the ink discharging opening, namely at the boundary portion between the portions 408 and 407, stress due to deformation of the support 409 and the solid surface treating agent 410 which occurs during peel-off is concentrated on one point to generate cohesive destruction of the surface treating agent, whereby separation from the support can be effected.

In the subsequent step, UV-ray is irradiated to the surface treating agent to effect curing for enhancement of ink resistance and abrasion resistance, thus completing the treatment.

FIG. 3 is a perspective view of the vicinity of the ink discharging opening of the ink jet recording head provided with a surface treated layer 110 C. This curing can be done by irradiation of actinic active rays when the surface treating agent 410 is a photosensitive resin as above, by heating when it is a thermosetting resin or by drying when it contains a solvent.

TABLE 3

| | wt. parts |
|---|---|
| DIANAL BR-80 (acrylic resin, MW, 95000, produced by MITSUBISHI RAYON Co., LTD.) | 100 |
| RIPOXY VR-60 (produced by SHOWA HIGH POLYMER Co., LTD.) | 50 |
| Trimethylolpropane triacrylate | 30 |
| IRGACURE 651 (produced by CIBA-GEIGY) | 5 |
| Tert-butylhydroquinone | 0.2 |
| Ethyl cellosolve | 100 |

Surface treatments were practiced with varying the thickness of surface treating agent on a support as shown in Table c, to 100 heads for each thickness. The results are shown in Table C.

In this EXAMPLE 3, the thickness of surface treating agent provided on a support was varied as shown in TABLE C and the surface treatment was effected to 100 heads for each thickness. The results are shown in TABLE C.

TABLE C

| Thickness of Surface Treating Agent on Support (μm) | Ratio of Ink discharging Opening/Thickness in the Left Column | Result |
|---|---|---|
| 0.1 | 1/400 | Ununiform Surface Treatment in two of 100 Heads |
| 0.13 | 1/300 | Ununiform Surface Treatment in One of 100 Heads |
| 0.4 | 1/100 | Successful in All Heads |
| 0.8 | 1/50 | ditto |
| 4 | 1/10 | ditto |
| 8 | 1/5 | ditto |
| 10 | 1/4 | Surface Treating Agent Intrusion into Ink Discharging Opening in One of 100 Hedas |
| 13 | 1/3 | Surface Treating Agent Intrusion into Ink Discharging Opening in 19 of 100 Heads |

EXAMPLE 4

Figure 9:
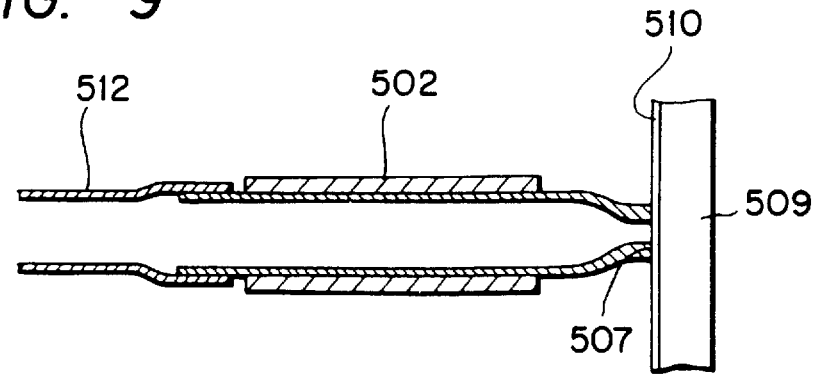
FIG. 9 is a schematic sectional view for illustration of another example of the surface treatment method of the present invention.

FIG. 9 is a schematic sectional view for illustrating this EXAMPLE 4. Initially, a solution of epoxy resin (thermosetting resin) having the composition shown in Table 4 was applied onto a polyester film 509 as a substrate having a thickness of 25 μm then dried at 80° C. for 5 minutes for toluene removal to form a solid layer of surface treating agent 510.

This was pressure adhered to the ink discharging surface 507 of an ink-jet recording head 501 of ink discharging opening diameter of 40 mm, and then the support was removed, whereby the solid surface treating agent was transferred to the ink discharging surface 507.

In the subsequent step, this was heated at 150° C. for two hours to cure the solid surface treating agent, thus completing the treatment with the result of enhancement in ink resistance and abrasion resistance.

Figure 10:
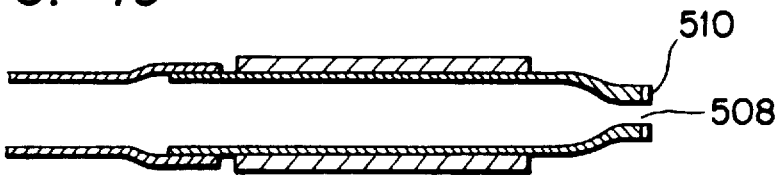
FIG. 10 is a schematic sectional view of the ink jet recording head after completion of the treatment according to the surface treatment method of the present invention.

FIG. 10 is a schematic sectional view of an ink-jet recording head provided with a surface treated layer 510 C after completion of the above treatment.

TABLE 4

| | wt. parts |
|---|---|
| DIANAL BR-80 (acrylic resin, MW. 95000, produced by MITSUBISHI RAYON Co.,LTD) | 20 |
| EPIKOAT 828 (produced by YUKA SHELL EPOXY Co., LTD) | 80 |
| 2-Ethyl-4-methylimidazole | 4 |
| Toluene | 100 |

In this EXAMPLE 4, the thickness of surface treating agent provided on a support was varied as shown in TABLE D and the surface treatment was effected to 100 heads for each thickness. The results are shown in TABLE D.

TABLE D

| Thickness of Surface Treating Agent on Support (μm) | Ratio of Ink discharging Opening/Thickness in the Left Column | Result |
|---|---|---|
| 0.1 | 1/400 | Ununiform Surface Treatment in One of 100 Heads |
| 0.13 | 1/300 | Successful in All Heads |
| 0.4 | 1/100 | ditto |
| 0.8 | 1/50 | ditto |
| 4 | 1/10 | ditto |
| 8 | 1/5 | ditto |
| 10 | 1/4 | ditto |
| 13 | 1/3 | Surface Treating Agent Intrusion into Ink Discharging Opening in 18 of 100 Heads |

[II] (ii) Next, examples of the third embodiment of surface treatment process.

As a support to be used in this embodiment, there may be preferably used, but not limited to, ones oxygen impermeable and transparent to active ray irradiation and having flexibility. Especially preferably, polyester films such as polyethylene terephthalate are used. In addition, polyamide, polyimide, polystyrene and polyolefin such as polyethylene and polypropylene films.

As a surface treating agent to be used in this embodiment, there may be preferably used, but not limited to, photosensitive resins containing an organic polymer binder, a radical polymerizable vinyl monomer and a sensitizer generating free radicals by active ray irradiation.

As the organic polymer binder, homopolymers or copolymers of various vinyl monomers may be employed. Suitable examples of vinyl monomers may include methyl methacrylate, butyl methacrylate, ethyl acrylate, styrene, α-methylstyrene, vinyl toluene, 2-hydroxyethyl methacrylate, 2-hydroxypropyl methacrylate, 2-hydroxyethyl acrylate, acrylic acid, methacrylic acid, glycidyl methacrylate, t-butylaminoethyl methacrylate, 2,3-dibromopropyl methacrylate, 3-chloro-2-hydroxypropyl methacrylate, hydroxypropyl methacrylate, acrylamide and acrylonitrile, etc.

As the radical polymerizable vinyl monomer, the vinyl monomers as mentioned above can be used. Further, polyfunctional vinyl monomers can be also used. Examples of these monomers may include 1,3-butanediol diacrylate, 1,4-butanediol acrylate, 1,6-hexanediol diacrylate, polyethylene glycol 200diacrylate, polyethylene glycol 400 diacrylate, polyethylene glycol 600 diacrylate, diethylene glycol diacrylate, neopentyl glycol diacrylate, triethylene glycol diacrylate, tripropylene glycol diacrylate, hydroxypivalate neopentyl glycol diacrylate, trimethylolpropane diacrylate, bis(acryloxyethoxy)bisphenol A, bis(acryloxyethoxy) tetrabromobisphenol A, bis(acryloxypolyethoxy)bisphenol A, 1,3-bis(hydroxyethyl)5,5-dimethylhydantoin, 3-methylpentanediol diacrylate, trimethylolpropane triacrylate, pentaerythritol triacrylate, tris(2-hydroxyethyl) isocyanate, pentaerythritol tetraacrylate, dipentaerythritol hexaacrylate, dipentaerythritol monohydroxypentaacrylate, etc.

Further, in the photosensitive resin to be used as a surface treating agent in this embodiment, a sensitizer which initiates radical polymerization of the above vinyl monomer by irradiation of an active ray is contained. Available sensitizers may be exemplified by acetophenone, 2,2-diethoxyacetophenone, p-dimethylaminoacetophenone, p-dimethylaminopropiophenone, benzophenone, 2-chlorobenzophenone, p,p-dichlorobenzophenone, p,p-bisdiethylaminobenzophenone, Michler's ketone, benzyl, benzoin, benzoin methyl ether, benzoin ethyl ether, benzoin isopropyl ether, benzoin n-propyl ether, benzoin isobutyl ether, benzoin n-butyl ether, benzyldimethylketal, tetramethylthiuram monosulfide, thioxanthone, 2-chlorothioxanthone, 2-methylthioxanthone, azobisisobutyronitrile, benzoin peroxide, di-tert-butylperoxide, 1-hydroxycyclohexyl phenyl ketone, 2-hydroxy-2-methyl-1-phenyl-1-one, 1-(4-isopropylphenyl)-2-hydroxy-2-methylpropane-1-one, methylbenzoyl formate, etc.

To describe briefly about the method for providing such surface treating agent on a support, it can be easily practiced by applying a liquid surface treating agent on the support by spinner coating, roll coating, bar coating, etc. followed by drying. The film thickness of the surface treating agent may be suitably as thin as possible because of susceptibility to oxygen inhibition as described below to cause readily cohesion destruction, but 0.1 $\mu$m to 10 $\mu$m may be considered to be suitable in view of the step of pressurizing uniformly the film.

When the surface treating agent is contacted with and adhered to the ink discharging orifice, which is the first step of the present invention, it is desirably performed under heated state, and hot roll laminater or vacuum laminater can be used.

During irradiation of the active ray to the surface treating agent which is the second step of this embodiment, at least the inside of ink pathway of the ink-jet recording head is arranged so as to be placed under an atmosphere containing oxygen. This may be sufficiently an air atmosphere, but it is more preferable to make it positively an oxygen atmosphere. This is done in order to utilize oxygen as a blocking agent of the radical polymerization, when the sensitizers generates radicals by irradiation of active ray to initiate radical polymerization of a vinyl monomer. For making the inside of ink pathway an atmosphere containing oxygen, such gas is introduced, for example, from behind the ink pathway, namely through the portion which becomes ink supplying passage.

As the light source for the active ray, one which generates light at around the wavelength 365 nm capable of initiating effectively the reaction of the sensitizer may be preferably used, such as UV-ray fluorescent lamp, xenon lamp, high pressure mercury lamp, ultra-high pressure mercury lamp, metal halide lamp, etc.

In the third state of this embodiment, the support is peeled off from the ink discharging surface. During this operation, the surface treating layer adhered on the ink discharging surface proceeds polymerization without receiving oxygen inhibition, whereby the cohesive force and the adhesive force with the ink discharging surface are enhanced, and therefore peeled off readily at the interface with the support to remain on the ink discharging surface of the ink jet recording head. On the other hand, the surface treating agent covering over the ink discharging orifice is not sufficiently proceeded in curing because polymerization is inhibited by the oxygen within the ink pathway. For this reason, cohesive force of the surface treating agent faced to the ink discharging opening is weak, and more strongly adhered to the support than to the ink discharging surface and therefore it is removed as attached on the support. Thus, by peeling off the support, the ink discharging opening is opened on the ink discharging surface.

By use of the materials selected as described above, the surface treatment is completed via the first to the third steps, and it is also preferable to perform thereafter heating treatment and further irradiation of an active ray for the purpose of enhancing ink resistance, abrasion resistance, adhesiveness.

EXAMPLE 5

Figure 11:
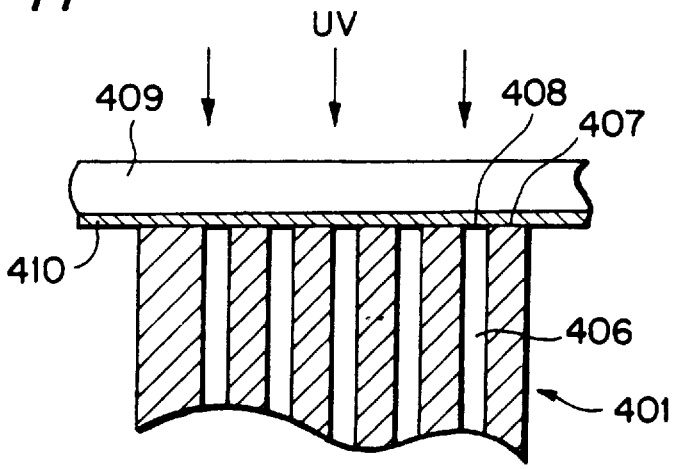
FIGS. 11 and 12 are each schematic sectional view for illustration of another example of the surface treatment method of the present invention.

FIG. 11 illustrates the fifth example of surface treatment process of the present invention, which is a schematic sectional view taken along the B–B' plane of the ink jet recording head 101 shown in FIG. 1A.

First, a photosensitive resin liquid having a composition as shown in Table 5 was applied by a wire bar on the support 409 of a polyester film (thickness 25 $\mu$m) and then dried to obtain a layer of surface treating agent 410. This was pressure adhered onto the ink discharging surface 407 of the ink jet recording head 401 of ink discharging opening diameter of 50 $\mu$m by use of roller 412, etc. at 130° C. under reduced pressure of 5 mm Hg (the first step).

Next, as shown in FIG. 11, the surface treating agent 410 was wholly subjected to light exposure through the support 409 (the second step). This exposure was done under an atmosphere of oxygen as described above, by use of a 1 kW ultra-high pressure mercury lamp by irradiation of UV-ray for one second.

Next, as shown in FIG. 8, the support 409 was peeled off (the third step). At this time, the portion of the surface treating agent 410 faced to the ink discharging opening 408 remained on the support 409 side, and the portion of the surface treating agent 410 directly contacted to the ink discharging surface remained on the ink jet recording head 401 side. This is because the portion of the surface treating agent 410 covering the ink discharging opening is inhibited in polymerization, whereby curing proceeded insufficiently to give only weak cohesive force.

In the subsequent step, the surface treating agent remained on the ink discharging surface is irradiated with UV-ray by use of a ultra-high pressure mercury lamp to further effect curing for enhancing ink resistance and abrasion resistance, thus completing the treatment.

In FIG. 3 is depicted the vicinity of the discharging opening of the ink jet recording head provided with a surface treated layer 110 C after the above treatment.

TABLE 5

| | wt. parts |
|---|---|
| DIANAL BR-80 (acrylic polymer, MW, 95000, produced by MITSUBISHI RAYON Co., LTD) | 100 |
| Trimethylolpropane triacrylate | 30 |
| IRGACURE 651 (produced by CIBA-GEIGY Co.) | 5 |
| Ethyl cellosolve | 100 |

In this EXAMPLE 5, the thickness of surface treating agent provided on a support was varied as shown in TABLE E and the surface treatment was effected to 100 heads for each thickness. The results are shown in TABLE E.

TABLE E

| Thickness of Surface Treating Agent on Support (μm) | Ratio of Ink discharging Opening/ Thickness in the Left Column | Result |
|---|---|---|
| 0.1 | 1/500 | Ununiform Surface Treatment in One of 100 Heads |
| 0.17 | about 1/300 | Successful in All Heads |
| 0.5 | 1/100 | Successful in All Heads |
| 1 | 1/50 | Successful in All Heads |
| 5 | 1/10 | Successful in All Heads |
| 10 | 1/5 | Successful in All Heads |
| 12.5 | 1/4 | Surface Treating Agent Intrusion into Ink Discharging Opening in 17 of 100 Hedas |

EXAMPLE 6

Figure 12:
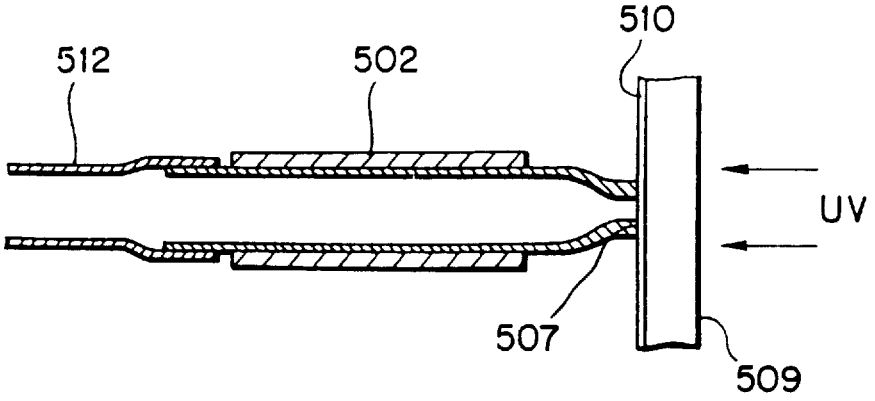

FIGS. 9 and 12 illustrate the sixth example of the present invention. First, a resin having a composition shown in the above Table 7 is applied on a polyester film 509 with a thickness of 25 μm which becomes the support similarly as described above and dried to prepare a surface treating agent layer 510.

This was pressure adhered onto the ink discharging surface 507 of the ink-jet recording head 501 of ink discharging opening diameter of 30 μm at 130 ° C. under a reduced pressure of 5 mm Hg as shown in FIG. 9. Next, as shown in FIG. 12, the inside of the ink pathway 206 was internally made an oxygen atmosphere, and after exposure of the surface treating agent on the whole surface to UV-ray for 1 sec. through the support 509 by a 1 kW ultra-high pressure mercury lamp, the support was peeled off. By this, the surface treating agent was transferred onto the ink discharging surface 507, whereby the resin covering over the ink discharging opening 508 was removed integrally with the support 509.

In the subsequent step, the surface treating agent was further cured by irradiation of UV-ray at 1 kW for 10 minutes for enhancement of ink resistance and abrasion resistance, thus completing the treatment.

FIG. 10 is a schematic sectional view of the ink jet recording head having a surface treated layer 510 C after completion of the treatment.

In this EXAMPLE 6, the thickness of surface treating agent provided on a support was varied as shown in TABLE F and the surface treatment was effected to 100 heads for each thickness. The results are shown in TABLE F.

TABLE F

| Thickness of Surface Treating Agent on Support (μm) | Ratio of Ink discharging Opening/ Thickness in the Left Column | Result |
|---|---|---|
| 0.1 | 1/300 | Successful in All Heads |
| 0.3 | 1/100 | Successful in All Heads |
| 0.6 | 1/50 | Successful in All Heads |
| 3 | 1/10 | Successful in All Heads |
| 6 | 1/5 | Successful in All Heads |
| 7.5 | 1/4 | Successful in All Heads |
| 10 | 1/3 | Surface Treating Agent Intrusion into Ink Discharging Opening in Two of 100 Heads |
| 15 | 1/2 | Surface Treating Agent Intrusion into Ink Discharging Opening in 19 of 100 Heads |

The present invention is not limited to three embodiments [I], [II] (i) and [II] (ii) as described in detail above. For example, in the present invention, the surface treating agent may be cured under the state where the support is in contact with a liquid surface treating agent with the ink discharging surface, and then the surface treating agent may be transferred onto the ink discharging surface to form a surface treated layer.

In this invention, "ink discharging opening diameter" is denoted by, for example, a (i.e. maximal diameter) in FIG. 1A or FIG. 9, and "the thickness of surface treating agent on the support" is denoted by, for example, a, and b are not shown in correct scale, but illustrated schematically for simplicity.

Next, the effects obtained in the above examples are described in detail.

Figure 13:
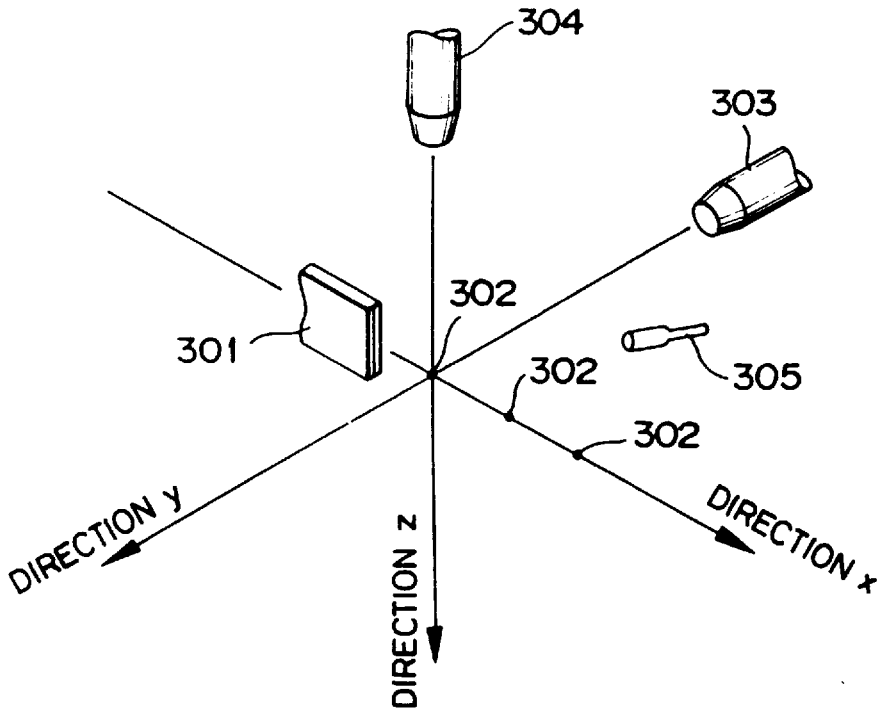
FIG. 13 is a schematic illustration showing the arrangement of a measuring device tar observation of the ink discharging characteristics.

FIG. 13 illustrates schematically arrangement of the measuring device for observation of the ink discharging characteristics. For observation of variance in direction and speed of the ink droplets 302 discharged from the ink discharging openings of the ink jet recording head shown by 301, video monitors 303 and 304 mounted with microscopes in the two directions y and z perpendicular to the flight direction x of ink droplets 302. Also, a storobo emitter 305 was actuated as synchronized with ink discharging frequency.

The ink jet recording heads having been subjected to surface treatment of the ink discharging surface according to the first to sixth examples were set as the ink jet recording head 301 on the measurement device, continuous ink discharging was performed for observation of ink droplets. In this test, the ink droplets were observed to be stationary on the x direction in both y and z direction. This indicates that the ink droplets progress straight forward and also the discharging speed is constant. Even after continuous discharging for a long time, this state remained unchanged.

In contrast, in the ink jet recording head without application of the above surface treatment, the ink droplets were sometimes positioned as deviated from the x direction, with fluctuation in the progress direction of the ink droplets. This indicates that in some instances the ink droplets did not progress straightforward and also the discharge speed was not constant. Also, when the surrounding of the ink discharging opening was observed at this time, attachment of ink was sometimes observed. No such phenomenon was observed in the ink jet recording head treated by the surface treatment method according to the above examples.

Next, the ink jet recording head was mounted on a printer, and printing was performed for evaluation of printing quality. As the ink jet recording head, one having 8 ink discharging openings was used. As the result, in the ink jet recording head treated by the method according to the first to sixth examples, stable printing quality was obtained for a long time. In contrast, in the untreated ink jet recording head, printing badness, namely the phenomenon of localization of dots constituting letters or formation of fine dots other than main dots, sometimes occurred, as printing is continued. At this time, ink was also observed to adhere to the ink discharging orifice. When the ink was wiped off, good printing quality was obtained for a while, but printing badness sometimes occurred soon thereafter.

Further, as comparative examples, the surface treating agents used in the above respective examples were provided on the ink discharging orifice surface according to the coating method to form a surface treated layer. Also, separately from them, surface treatments were applied to the ink discharging surface according to the evaporation method in place of the coating method as comparative examples.

As the result, it was found that surface treating agents sometimes entered internally of the ink discharging orifices or some were not provided uniformly with respect to the thickness or characteristics of surface treated layer Thus, the ink jet recording heads according to comparative examples included those which were not good in discharge characteristics of ink.

As described above the following effects can be obtained according to the present invention.

(1) Ink discharging surface can be treated uniformly.

(2) Ink discharging surface around openings is free from roughness or flaw, etc.

(3) Discharging direction, discharging speed and the particle size of ink droplets discharged become constant to improve recording quality.

(4) Since good printing quality can be obtained even when discharging frequency may be increased, recording speed can be increased.

(5) No special treatment for avoiding intrusion of the surface treating agent into pathway is required during surface treatment.

(6) Bulk production can be easily done to provide inexpensive ink jet recording heads.

(7) The shape of the ink discharging opening is not changed by surface treatment, and therefore no restriction is imposed on designing.

We claim:

1. A method for suface treatment of an ink jet recording head having an ink discharging opening surface with ink discharging openings each having a predetermined diameter, the method comprising the steps of:

preparing a coating roll for applying a surface treating agent which is a liquid to the ink discharging opening surface;

forming on the surface of the coating roll a layer of the surface treating agent having a uniform thickness of 0.3 $\mu$m to 6 $\mu$m with a roll disposed in a vicinity of the coating roll, the thickness of the layer of the surface treating agent not being more than one third of the predetermined diameter of the ink discharge openings; and applying the surface treating agent to the ink discharging opening surface by rotating the coating roll on the surface of which the layer of the surface treatment agent is formed.

2. A method as in claim 1, wherein the surface treating agent has an ink repellent property.

3. A method as in claim 1, wherein the roll rotates in a direction which is reverse to a rotating direction of the coating roll.

* * * * *

UNITED STATES PATENT AND TRADEMARK OFFICE

CERTIFICATE OF CORRECTION

PATENT NO. : 5,838,347
DATED : November 17, 1998
INVENTOR(S) : Tadayoshi Inamoto et al.

It is certified that error appears in the above-identified patent and that said Letters Patent is hereby corrected as shown below:

Column 1,
Line 10, "an Continuation" should read -- a continuation --.
Line 48, "differ" should read -- differs --.

Column 2,
Line 31, "FIG." should read -- FIGS. --.
Lines 38 and 41, "views" should read -- view --.
Line 57, "each" should read -- each a --.
Line 61, "tar" should read -- for --.

Column 3,
Line 54, "agent" should read -- agent to --.
Line 57, "enter" should read -- enters --.
Line 65, "03. $\mu$m" should read -- 0.3 $\mu$m --.

Column 5,
Line 10, "and" should read -- an --.
Line 39, "resinsolution" should read -- resin solution --.

Column 6,
Line 52, "passway" should read -- pathway --.

Column 8,
Line 30, "long" should read -- along --.

Column 9,
Line 39, "Hedas" should read -- Heads --.

Column 10,
Line 65, "200diacrylate" should read -- 200 diacrylate --.

Column 11,
Line 52, "generates" should read -- generate --.

UNITED STATES PATENT AND TRADEMARK OFFICE

CERTIFICATE OF CORRECTION

PATENT NO. : 5,838,347
DATED : November 17, 1998
INVENTOR(S) : Tadayoshi Inamoto et al.

It is certified that error appears in the above-identified patent and that said Letters Patent is hereby corrected as shown below:

Column 12,
Line 22, "resistance," should read -- resistance, or --.
Line 59, "remained" should read -- remaining --.

Column 13,
Line 35, "Hedas" should read -- Heads --.

Column 15,
Line 34, "layer" should read -- layer. --.

Signed and Sealed this

Eighth Day of October, 2002

*Attest:*

*Attesting Officer*

JAMES E. ROGAN
*Director of the United States Patent and Trademark Office*